US006286653B1

(12) United States Patent
Yamagishi et al.

(10) Patent No.: US 6,286,653 B1
(45) Date of Patent: Sep. 11, 2001

(54) COIN SORTER

(75) Inventors: Ryoji Yamagishi, Kawagoe; Masato Yagi, Urawa, both of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/402,568

(22) PCT Filed: Jan. 19, 1999

(86) PCT No.: PCT/JP99/00168

§ 371 Date: Oct. 5, 1999

§ 102(e) Date: Oct. 5, 1999

(87) PCT Pub. No.: WO99/40547

PCT Pub. Date: Aug. 12, 1999

(30) Foreign Application Priority Data

Feb. 5, 1998 (JP) ..... 10-024590
Feb. 13, 1998 (JP) ..... 10-031458

(51) Int. Cl.[7] ..... G07F 1/04; G07F 9/10
(52) U.S. Cl. ..... 194/345; 194/350
(58) Field of Search ..... 194/350, 345, 194/321

(56) References Cited

U.S. PATENT DOCUMENTS

| | | | | |
|---|---|---|---|---|
| 4,106,608 | * | 8/1978 | Dietz | 194/345 |
| 4,881,630 | * | 11/1989 | Kobayashi et al. | 194/345 |
| 5,404,985 | | 4/1995 | Baughman . | |
| 5,829,569 | * | 11/1998 | Cheng et al. | 194/345 |

FOREIGN PATENT DOCUMENTS

| | | |
|---|---|---|
| 45-021208 | 8/1970 | (JP) . |
| 51-006322 | 2/1976 | (JP) . |
| 57-042457 | 3/1982 | (JP) . |
| 59-171348 | 9/1984 | (JP) . |
| 60-039182 | 2/1985 | (JP) . |
| 6044162 | 3/1985 | (JP) . |
| 61-000683 | 1/1986 | (JP) . |
| 8-096197 | 4/1996 | (JP) . |
| 8096197 | 4/1996 | (JP) . |

* cited by examiner

*Primary Examiner*—Robert P. Olszewski
*Assistant Examiner*—Bryan Jaketic
(74) *Attorney, Agent, or Firm*—Hogan & Hartson L.L.P.

(57) ABSTRACT

A coin sorter, wherein a front cover, a gate rail and a solenoid out of independent parts constituting the coin sorter are supported so that they can be detached with a snap action respectively.

6 Claims, 15 Drawing Sheets

COIN SORTER

TECHNICAL FIELD

The present invention relates to a coin sorter which sorts inserted coins into authentic or counterfeit and coins sorted as authentic by denomination, and more particularly to a configuration for fitting independent components of the coin sorter.

BACKGROUND ART

Generally speaking, coin sorters identify each of inserted coins as authentic or counterfeit, further identify the denominations of coins identified as authentic, and sort these inserted coins by channelling each of these coins into different coin passages.

Such coin sorters consist of various independent components such as a main plate which constitutes the body of the device, and a front cover which covers the front surface of the main plate in such a manner that it is capable of being opened and closed freely.

The main plate, being one of these independent components, is equipped with a coin inlet through which the coins are inserted, and electronic coin identifying means which is referred to as a coin sensor and identifies inserted coins as authentic or counterfeit and the denominations of authentic coins. A coin sorting lever located on the main plate is operated in accordance with signals transmitted by the electronic coin identifying means, which indicate that inserted coins are authentic or counterfeit and further indicate the denominations of authentic coins, so that the inserted coins are each channelled into different coin passages, thus sorting them into authentic or counterfeit and further sorting authentic coins by denomination.

As mentioned above, the main plate also has other independent components such as coin passages which serve to guide the coins by denomination and a sorting lever. These components are normally covered with the front cover so as not to be exposed. At the front cover, a portion of the coin passages may be formed on the rear side thereof.

One of the functions of this front cover is to allow the front of the main plate to be opened up to reveal the coin passages, sorting lever and other components disposed on the front cover during servicing and maintenance of these components, with the object of facilitating the operation of servicing and maintenance. The front cover of a conventional type is an independent component, and is configured in such a manner that it is fitted on to the main plate by engaging claws formed on either side of it with apertures formed on either side of the main plate.

The abovementioned coin sorter is equipped also with a metal gate rail serving directly to receive coins which drop down from the coin inlet, and guide them towards the coin passage in which is located the electronic coin identifying means referred to as a coin sensor, which serves to identify coins received in this manner as authentic or counterfeit, and further identify the denominations of authentic coins. Coins passing along the coin passage in which the electronic coin identifying means is located are identified during their passage by the electronic coin identifying means as authentic or counterfeit, and authentic coins are further identified by denomination.

Inserted coins passing through the abovementioned coin passage are further guided into a plurality of coin passages which branch off from the abovementioned coin passage. At each of the points where the plurality of coin passages branch off is located a coin sorting lever, being another independent component, which is operated in accordance with coin identification signals transmitted from the electronic coin identifying means, and serves to channel the inserted coins into each of the plurality of the branch coin passages, thus sorting coins as authentic or counterfeit and further sorting authentic coins by denomination.

The coin sorting lever is an independent component and is driven by a solenoid which operates in accordance with coin identification signals transmitted from the electronic coin identifying means.

The gate rail, which is another independent component of the coin sorter, and the solenoid which drives the coin sorting levers have conventionally been configured in such a manner that screws are used to attach them in prescribed positions on the coin sorter.

In other words, the gate rail, which is an independent component, is attached by means of screws on to the gate plate which serves to open and close the coin inlet. Meanwhile, the solenoid, which drives the coin sorting levers, is attached by means of screws to the rear surface of the main plate which constitutes the body of the coin sorter.

Now, inasmuch as the conventional coin sorter is configured in such a manner that the front cover is attached by engaging claws formed on either side of it with apertures formed on either side of the main plate, it presents problems because the operation of attaching it is extremely troublesome. Not only that, but when the front cover is to be removed from the main plate during maintenance and servicing, it is necessary to disengage the engaging claws from the apertures, and this also is a troublesome operation.

Moreover, inasmuch as the conventional coin sorter is configured in such a manner that the gate rail and solenoid, which are independent components thereof, are attached in prescribed positions on the coin sorter with the aid of screws, the operation of attaching and detaching them is complicated, so that the number of processes required for assembling the device is increased, and the number of operations which need to be performed during maintenance and servicing thereof is also increased. This in turn makes the device more costly, and increases the expenditure involved in maintenance and servicing.

In a view of the abovementioned circumstances, it is an object of the present invention to provide a coin sorter which is easy to attach and detach independent components thereof to and from it.

DISCLOSURE OF THE INVENTION

With the aim of solving the abovementioned problems, the first coin sorter to which the present invention pertains is a coin sorter comprising a main plate which constitutes a body of the device, and a front cover which covers a front surface of the main plate in such a manner as to be capable of being opened and closed freely, characterized in that the coin sorter further comprises a shaft provided on one edge of the front cover; and bearing means provided on one edge of the main plate in such a manner that the shaft is fitted into the bearing means from one direction by virtue of a snap action and rotatably supported by the bearing means, whereby the front surface of the main plate is covered with the front cover in such a manner as to be capable of being opened and closed freely by rotating the front cover about the shaft.

With the configuration in which a shaft formed on one edge of the front cover is inserted by virtue of a snap action into bearing means formed on one edge of the main cover, and is supported by it in such a manner that the front cover is capable of being rotated freely around the shaft means, the front cover can be attached and detached in a simple operation, thus reducing the number of manufacturing processes involved especially in the operation of assembling the coin sorter, and considerably improving ease of assembly, while at the same time greatly facilitating the operation of maintaining and servicing the device.

The second coin sorter to which the present invention pertains is a coin sorter characterized in that a snap-type gate rail supporting means is provided below a coin inlet, whereby a gate rail which directly receives coins falling down from the coin inlet and guides the coins towards a prescribed coin passage is fitted into and supported by the gate rail supporting means by virtue of a snap action.

Further, the third coin sorter to which the present invention pertains is a coin sorter characterized in that the main plate which constitutes a body of the device is formed with a snap-type solenoid supporting means, whereby a solenoid for driving a coin sorting lever which serves to channel inserted coins towards different coin passages is fitted into and supported by the solenoid supporting means by virtue of a snap action.

With the configuration of the second and third coin sorters to which the present invention pertains, the independent components which constitute the device, and especially the gate rail and the solenoids which drive the coin sorting levers, are supported by virtue of a snap action in prescribed positions on the coin sorter in such a manner as to be capable of being attached and detached freely means that the gate rail and solenoids can be attached and detached in a simple operation, reducing the number of manufacturing processes involved especially in the operation of assembling the coin sorter, and considerably improving ease of assembly, while at the same time greatly facilitating and accelerating the operation of maintaining and servicing the device. In this way it is possible to reduce the costs both of manufacturing the coin sorter, and of maintaining and servicing it.

BEST MODE FOR CARRYING OUT THE INVENTION

There follows a detailed description of a first embodiment of the coin sorter to which the present invention pertains.

Figure 1:
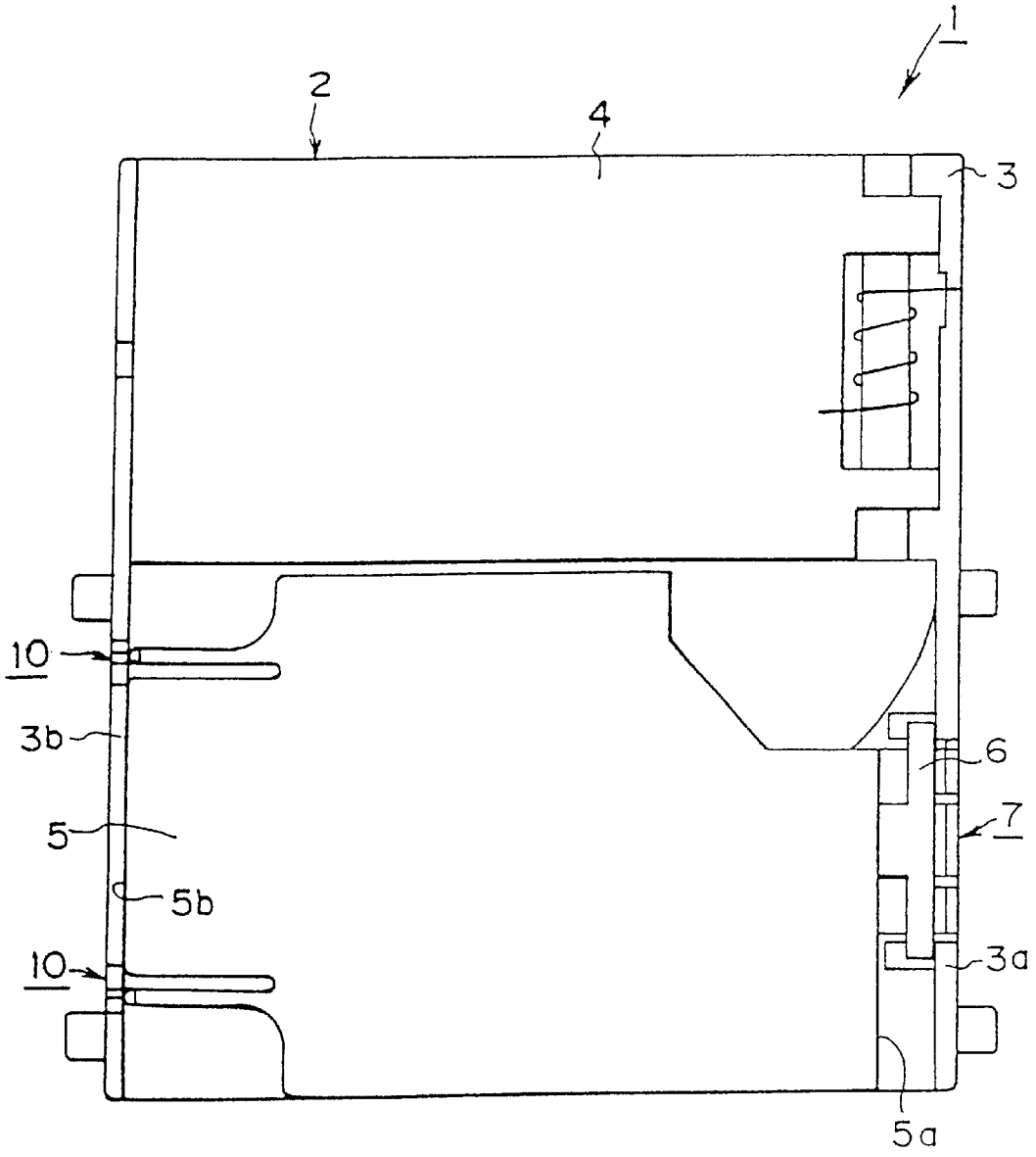
FIG. 1 is a front view of the first coin sorter to which the present invention pertains.

FIG. 1 is a front view of the first coin sorter to which the present invention pertains.

This coin sorter 1 is a compact model of the sort which may especially be installed between pin-ball and other gaming machines. It handles only a relatively small number of denominations of coin, identifying and sorting two types of coin of differing diameters, and identifying any other coins as counterfeit.

The coin sorter 1 comprises a main plate 3, on the upper surface of which is formed a coin inlet 2. The upper front surface of the main plate 3 is covered with a gate plate 4, which can be opened and closed freely, while the lower front surface is covered with a front cover 5.

In the part of the main plate 3 which is covered with the gate plate 4 is formed a coin passage, which is not illustrated in the drawing but which serves to guide coins inserted through the coin inlet 2. This coin passage is equipped with an electronic coin identifying means, which serves to identify inserted coins as authentic or counterfeit, and further to identify the denominations of authentic coins. Meanwhile, in the part of the main plate 3 which is covered with the front cover 5 are formed coin sorting levers, which are not illustrated in the drawing but which serve to sort the inserted coins, and different coin channels which guide the coins sorted by means of these coin sorting levers according to their denomination.

On the right-hand side 5*a* of the front cover 5 protrudes integrally a shaft 6, while on the right-hand side 3*a* of the main plate 3 facing this shaft 6 is formed integrally bearing means 7 into which by virtue of a snap action the shaft is inserted from one direction and thus supported.

Meanwhile, on the left-hand side 5*b* of the front cover 5 and on the left-hand side 3*b* of the main plate 3 facing it are formed latching means 10 which similarly by virtue of a snap action serve to support the left-hand side 5*b* of the front cover 5 on the main plate 3.

There follows a detailed description of the abovementioned shaft 6 formed on the front cover 5, and the bearing means 7 formed on the main plate 3.

Figure 2:
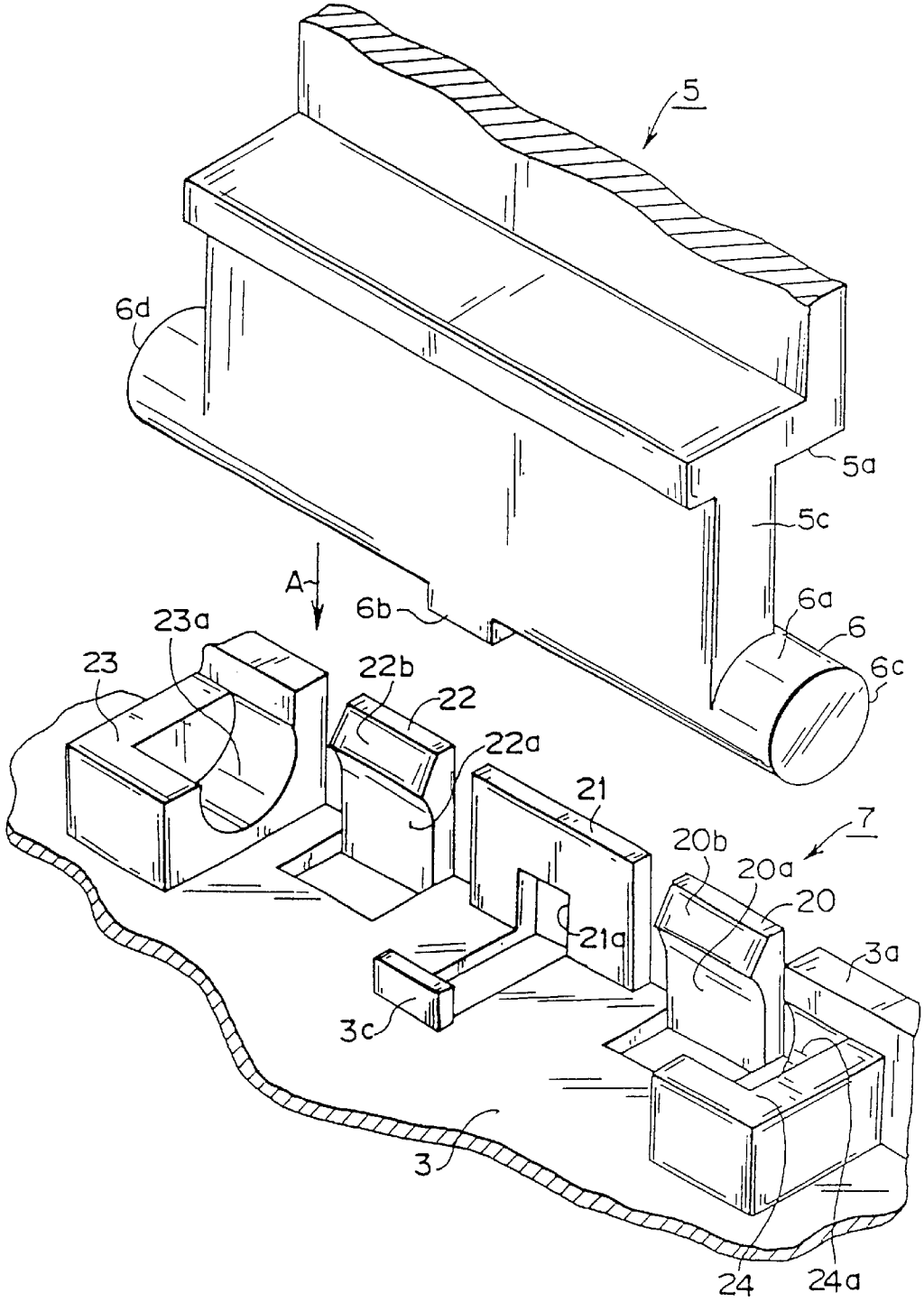
FIG. 2 is an exploded perspective view of principal portions of the first coin sorter to which the present invention pertains.

FIG. 2 is an exploded perspective view of principal portions of the first coin sorter to which the present invention pertains, and illustrates the shaft 6 and the bearing means 7 into which the shaft 6 is inserted and thus supported. More precisely, it depicts the front cover 5 detached from the main plate 3 and allowed to stand upright in relation to the main plate 3.

The shaft 6 is formed on the leading edge of a tongue 5*c*, which has a roughly L-shaped cross section and extends from the right-hand side 5*b* of the front cover 5. One centrally located portion of the peripheral surface 6*a* thereof is provided with an engagement member 6*b* which protrudes towards the main plate 3.

Meanwhile, the bearing means 7 comprises three tongues 20, 21, 22 located on the right-hand side 3*a* of the main plate 3, and a pair of bearing members 23, 24 formed in positions on either side of these three tongues 20, 21, 22. It should be added that this pair of bearing members 23, 24 and the three tongues 20, 21, 22 are formed integrally with the main plate 3.

On the upper surfaces of the pair of bearing members 23, 24 are formed depressions 23*a*, 24*a* having half-moon-shaped cross section into which are inserted the corresponding ends 6*c*, 6*d* of the shaft 6 in such a manner as to be supported. Arc-shaped portions 20*a*, 22*a* are formed parallel to the peripheral surface 6*a* of the shaft 6 on the sides of each of the three tongues 20, 21, 22 with the exception of the tongue 21 which is located in the center, the purpose being to support part of the peripheral surface 6*a* of the shaft 6.

In addition, inclined surfaces 20*b*, 22*b* are formed on the upper portions of the tongues 20, 22 so that when the shaft 6 is inserted and supported on them, they come into contact with the peripheral surface 6*a* thereof, causing the tongues 20, 22 to deflect with a snap action in a clockwise direction around their bases.

On the centrally located tongue 21 is formed an engagement aperture 21*a* with which the aforesaid engagement member 6*b* provided on the peripheral surface 6*a* of the shaft 6 engages when the shaft 6 is rotated to a prescribed angle, and which serves to restrict rotation beyond this prescribed angle. Additionally, there is located on the main plate 3 in a position facing this engagement aperture 21*a* an engagement member 3*c*, which similarly serves to restrict rotation of the shaft 6 beyond this prescribed angle.

As may be seen from FIG. 2, the action of the shaft 6 and the bearing means 7 formed on the front cover 5 and main plate 3 respectively is as follows. If the front cover 5 is caused to move vertically downwards as represented by the arrow A while still standing upright in relation to the main plate 3, what happens first is that the peripheral surface 6*a* of the shaft 6 comes into contact with the inclined surfaces 20*b*, 22*b* of the tongues 20, 22, thus causing the tongues 20, 22 to deflect with a snap action in a clockwise direction around their bases. It continues to move downwards, and as FIG. 3 demonstrates, the ends 6*c*, 6*d* of the shaft 6 fit into the depressions 23*a*, 24*a* of the bearing members 23, 24. At the same time, the tongues 20, 22 shown in FIG. 2 spring back to their initial position, so that the peripheral surface 6*a* of the shaft 6 is supported by the arc-shaped portions 20*a*, 22*a* of the tongues 20, 22, while being held within the depressions 23*a*, 24*a*.

In other words, lowering the abovementioned front cover 5 from a upright position (from one direction) in relation to the main plate 3 allows the shaft 6 to be inserted by virtue of the snap action of the pair of tongues 20, 22 into the depressions 23*a*, 24*a* of the pair of bearing members 23, 24 and to be supported there, further allowing the front cover 5 to be supported in such a manner as to be capable of rotating freely around the shaft 6.

Figure 3:
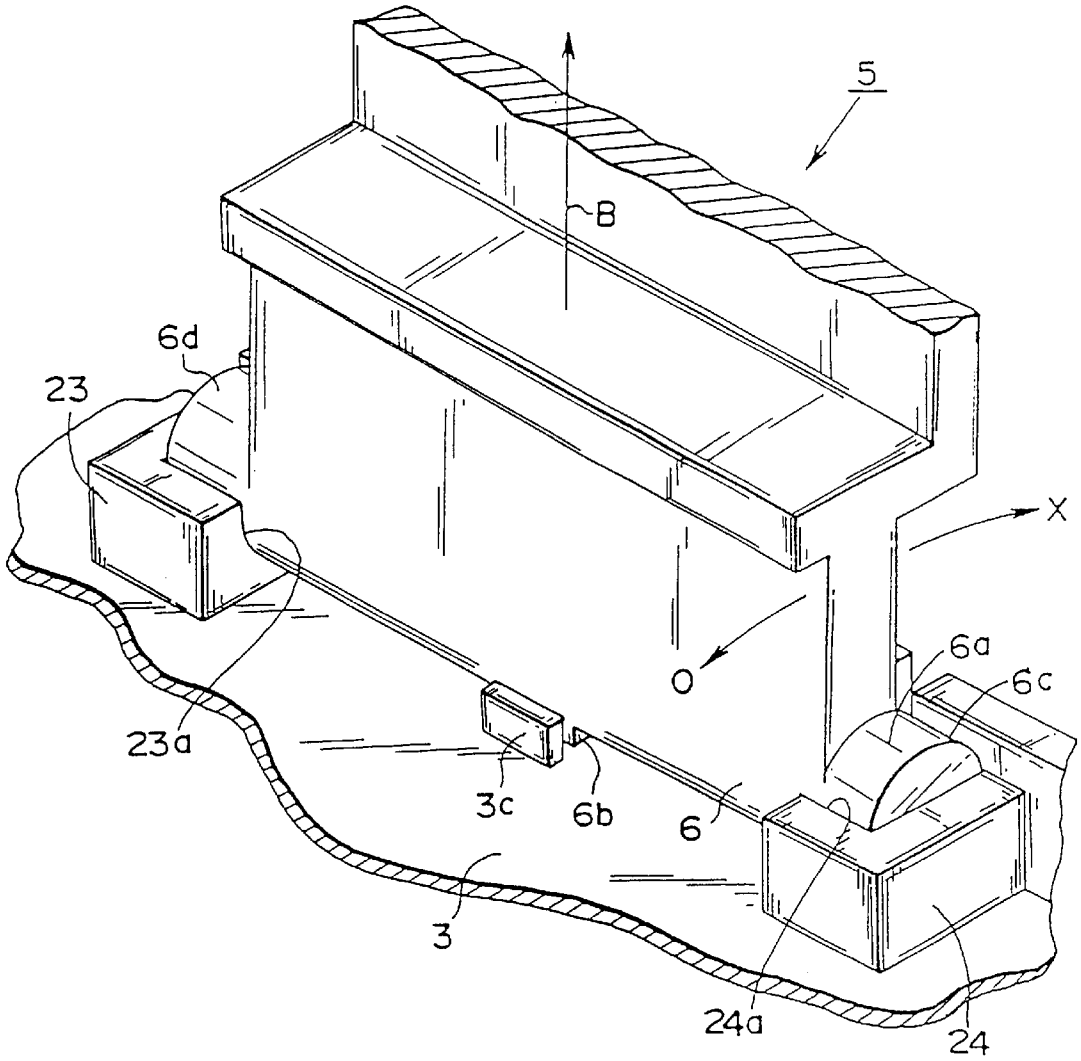
FIG. 3 is a perspective view of principal portions of the first coin sorter to which the present invention pertains.

Meanwhile, as FIG. 3 shows, if the front cover 5 is caused to move vertically upwards as represented by the arrow B while still standing upright in relation to the main plate 3, what happens is that the tongues 20, 22, which engage with the peripheral surface 6*a* of the shaft 6 through the medium of the arc-shaped portions 20*a*, 22*a* depicted in FIG. 2, deflect from their initial position in a clockwise direction around their bases. As a result of this, the peripheral surface 6*a* of the shaft 6 is released from the support of the arc-shaped portions 20*a*, 22*a* of the tongues 20,22, allowing the front cover 5 to be detached easily from the main plate 3.

As will be clear from FIG. 3, any attempt to rotate the front cover 5 in a clockwise direction around the shaft 6 from an upright position in relation to the main plate 3 results in contact between the engagement member 6*b* located on one portion of the peripheral surface 6*a* and the engagement member 3*c* formed on the main plate 3, thus restricting rotation of the front cover 5 in a clockwise direction.

If an attempt is made from the state illustrated in FIG. 3 to rotate the front cover 5 slightly around the shaft 6 and then release the front cover 5, both the interior peripheral surfaces of the depressions 23*a*, 24*a* in the bearing members 23, 24 and the arc-shaped portions 20*a*, 22*a* engage with the shaft 6, preventing it from being released and making it impossible to attach or detach the front cover 5 from that direction.

Consequently, attachment and detachment of the front cover 5 can be effected only in one direction where the front plate 5 is upright in relation to the main plate 3, as illustrated in FIG. 2.

Figure 4:
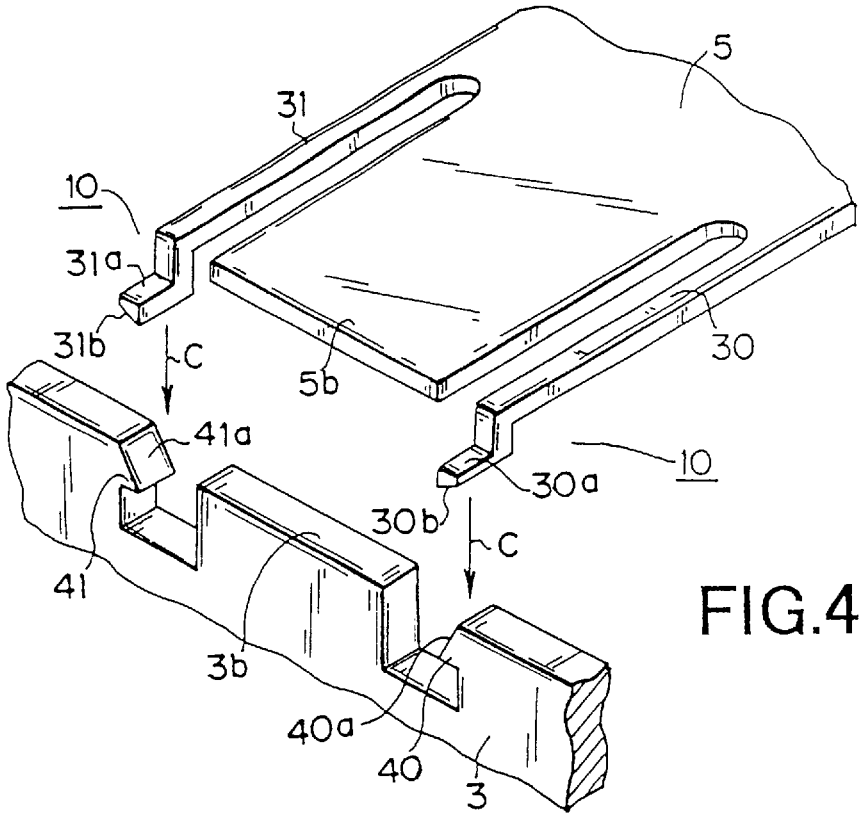
FIG. 4 is an exploded perspective view of the latching means.

Meanwhile, as the enlarged disassembled perspective view depicted in FIG. 4 shows, the latching means 10 which serves to support the left-hand side 5*b* of the front cover 5 on the left-hand side 3*b* of the main plate 3 as illustrated in FIG. 1 comprises a pair of arms 30, 31 which extend towards the left-hand side 5*b* of the front cover 5 in such a manner as to be capable of being deflected in a horizontal direction by virtue of a snap action, engaging claws 30*a*, 31*a* which are formed on the leading edges of the arms 30, 31 and have a roughly L-shaped cross section, and a pair of engaging claws 40, 41 which are formed on the main plate 3 in positions facing the engaging claws 30*a*, 31*a* of the arms 30, 31.

On the lower surfaces of the pair of engaging claws 30*a*, 31*a* and on the upper surfaces of each of the pair of engaging claws 40, 41 are formed inclined surfaces 30*b*, 31*b*, 40*a*, 41*a* which by coming into contact with each other serve to deflect the pair of arms 30, 31 in a direction of making closer to each other.

As is demonstrated by the arrows C in FIG. 4, when the front cover 5 is pressed towards the main plate 3 and the inclined surfaces 30*b*, 31*b* of the pair of engaging claws 30*a*, 31*a* are allowed to slide into contact against the inclined surfaces 40*a*, 41*a* of the pair of engaging claws 40, 41, the abovementioned latching means 10 causes the pair of arms 30, 31 to deflect towards each other, thus decreasing the distance between them.

If the front cover 5 is pressed further against the main plate 3 so as to release the contact between the inclined surfaces 30*b*, 31*b* of the pair of engaging claws 30*a*, 31*a* and the inclined surfaces 40*a*, 41*a* of the pair of engaging claws 40, 41, the deflected pair of arms 30, 31 return to their initial positions by virtue of a snap action. Thus, as FIG. 5 shows, the pair of engaging claws 30*a*, 31*a* on the front cover 5 and the pair of engaging claws 40, 41 on the main plate 3 engage with each other, which serves to allow the left-hand side 5*b* of the front cover 5 to be supported on the left-hand side 3*b* of the main plate 3.

In other words, the pair of engaging claws 30*a*, 31*a* on the front cover 5 engage with the pair of engaging claws 40, 41 by virtue of the snap action of the pair of arms 30, 31.

Figure 5:
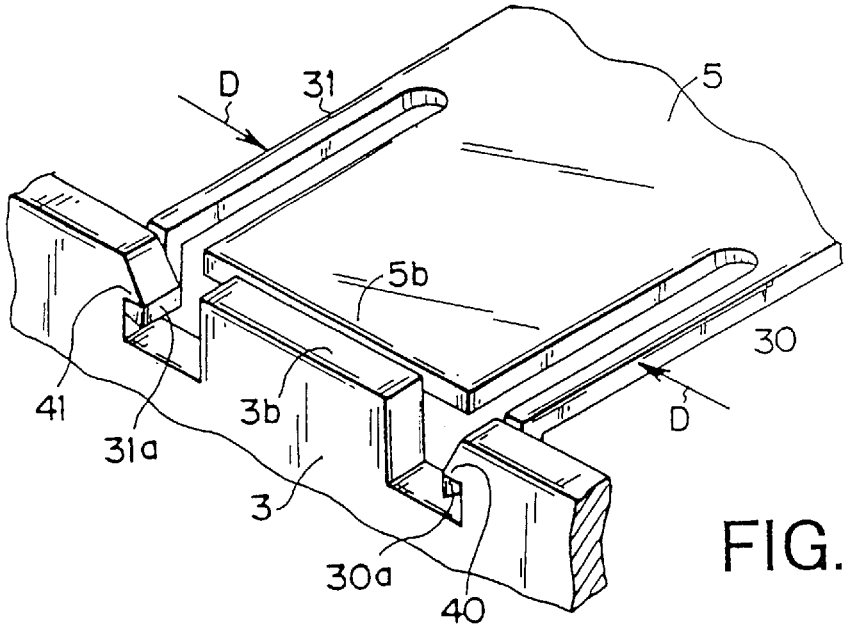
FIG. 5 is a perspective view of the latching means.

It should be added that the abovementioned pairs of engaging claws 30*a,* 31*a* and 40, 41 can easily be released from each other if the operator grasps the pair of arms 30, 31 and causes them to deflect towards each other as illustrated by the arrows D in FIG. 5.

There follows a detailed description of the operation of attaching and detaching the front cover 5.

Figure 6:
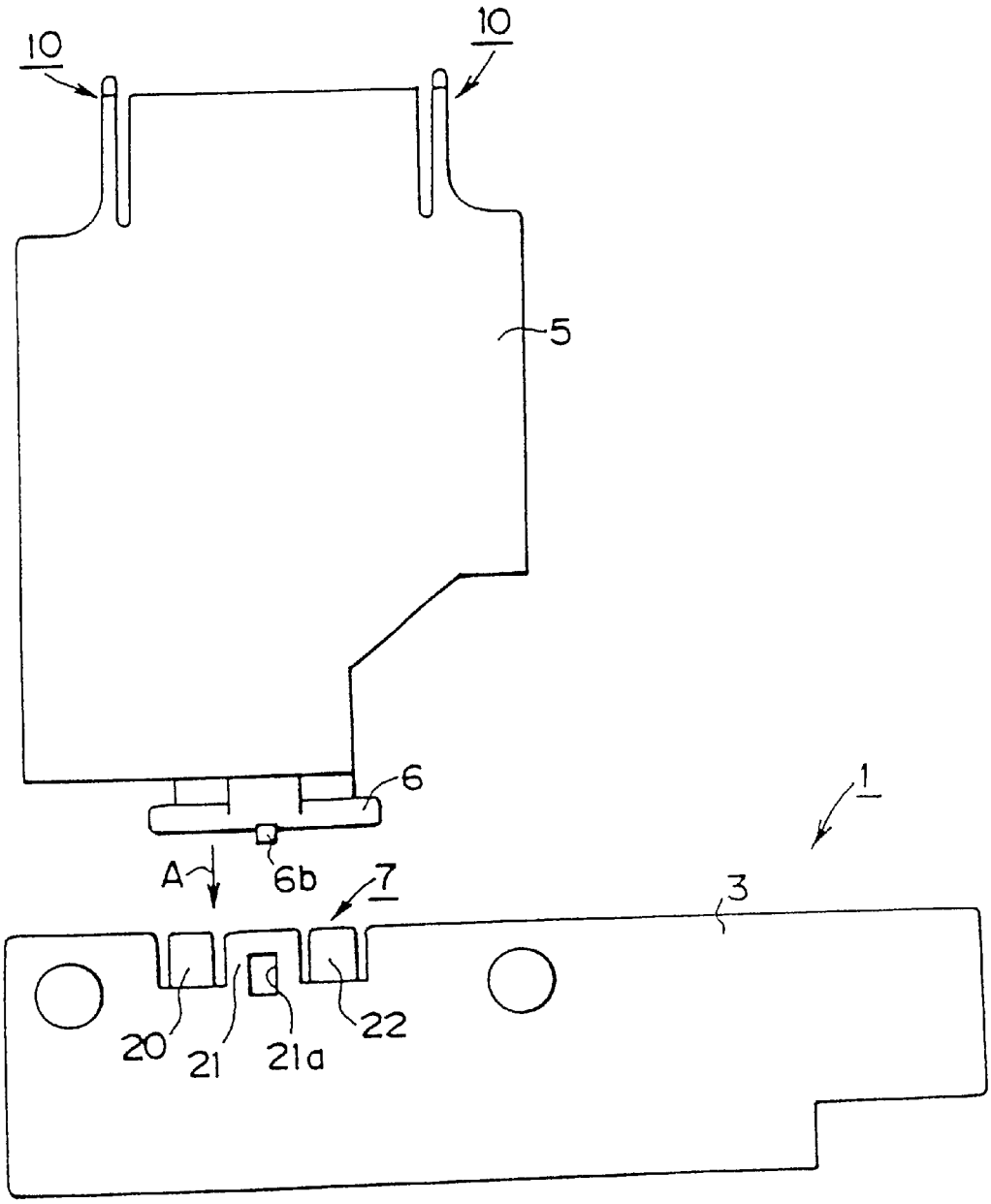
FIG. 6 is a side view illustrating the action of the first coin sorter to which the present invention pertains.

First of all, in order to attach the front cover 5 to the main plate 3, the front cover 5 is made to stand upright in relation to the main plate 3 of the coin sorter 1, which is placed horizontally as depicted in FIG. 6, where the same parts are allocated the same numerals or symbols as in FIGS. 1–3. The front cover 5 is then lowered as represented by the arrow A, thereby causing the shaft 6 formed on the front cover 5 to be inserted into the bearing means 7 on the main plate 3 in such a manner as to be supported there. Thus, by virtue of the snap action the front cover 5 is easily attached to the main plate 3.

Figure 7:
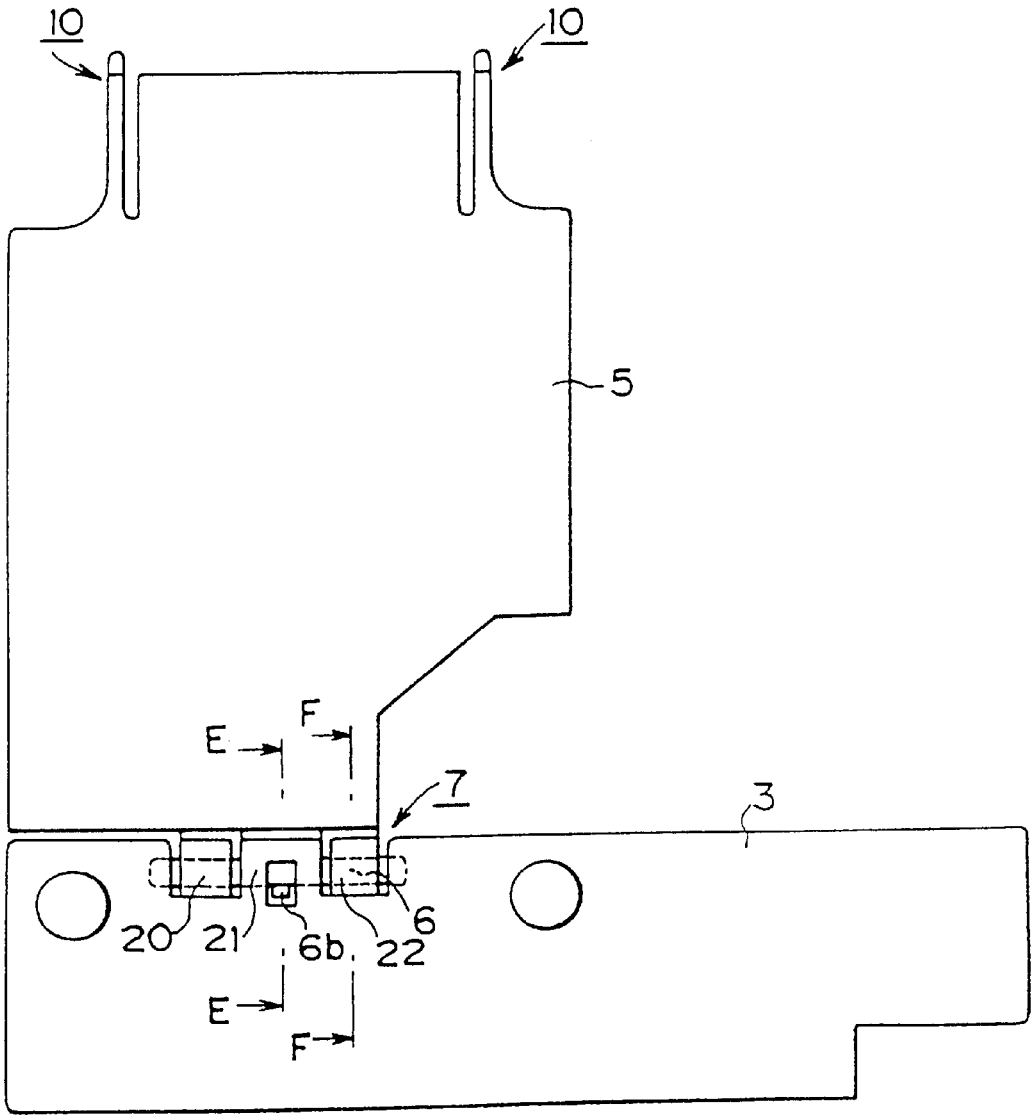
FIG. 7 is a side view illustrating the action of the first coin sorter to which the present invention pertains.
Figure 8:
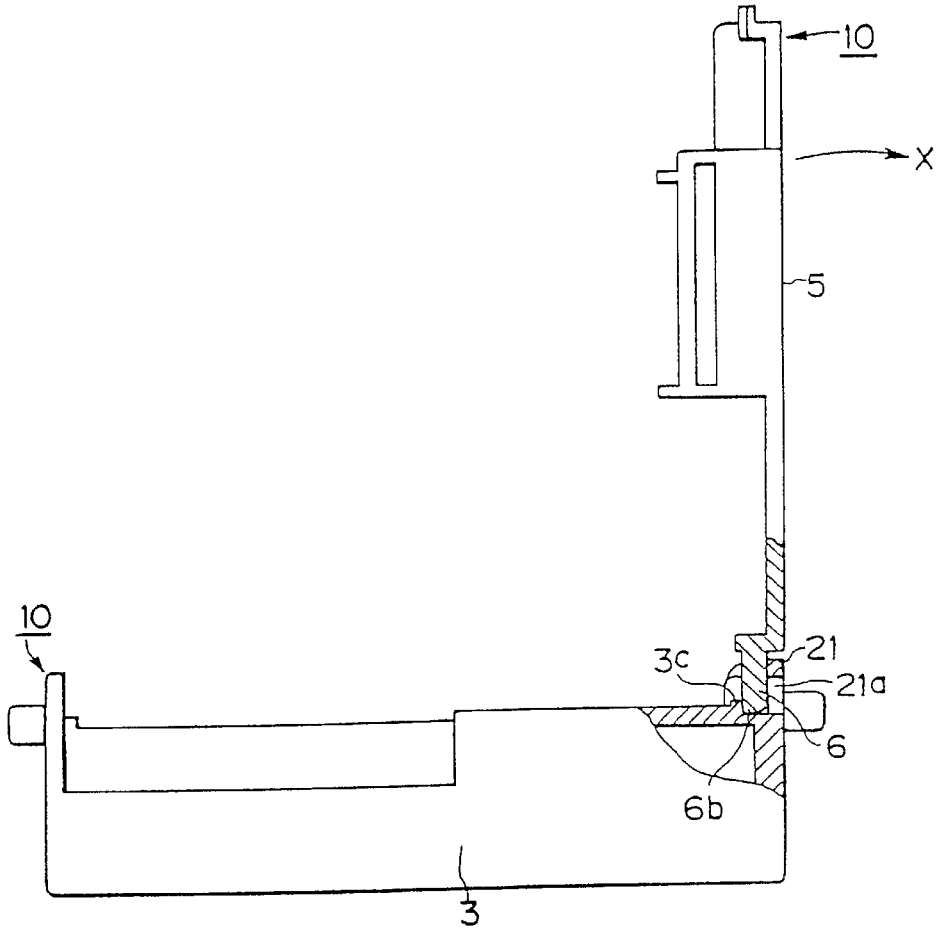
FIG. 8 is a sectional view of the principal part of the coin sorter viewed along the line E—E in FIG. 7.
Figure 9:
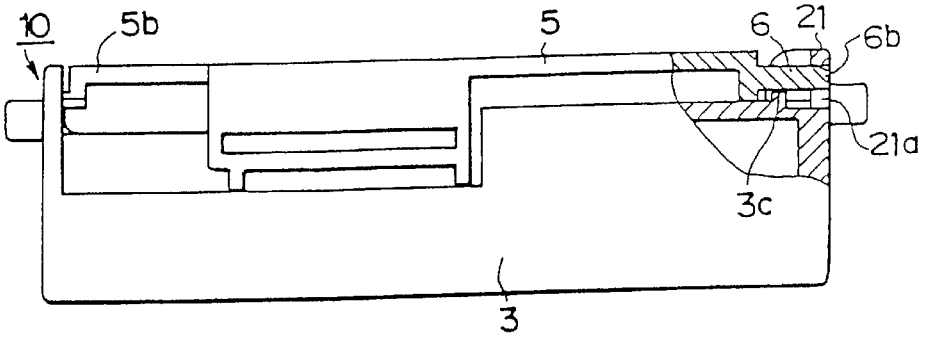
FIG. 9 is a view showing the front cover closed in FIG. 8.

Meanwhile, when the shaft 6 of the front cover 5 has been inserted into the bearing means 7 of the main plate 3 and is supported by it as in FIG. 7, the engagement member 6*b* located on the peripheral surface of the shaft 6 and the engagement member 3*c* formed on the main plate 3 are positioned so as to come into contact with each other, as may be seen from FIG. 8, which is a sectional view of the principal part along the line E—E in FIG. 7. As a result, rotation of the front cover 5 in a clockwise direction around the shaft 6 from the initial position depicted in FIG. 8 is restricted, and only rotation in an anticlockwise direction is permitted. This means that it is impossible to open the front cover 5 further than necessary in a clockwise direction around the shaft 6.

If the front cover is rotated in an anticlockwise direction around the shaft 6 from the position illustrated in FIG. 8, and the main plate 3 is closed, the engagement member 6*b* located on the peripheral surface of the shaft 6 comes into contact with the engagement aperture 21*a* formed in the tongue 21, with the result that excessive rotation of the front cover 5 in an anticlockwise direction around the shaft 6 is also restricted.

The left-hand side of the front cover 5 is attached by virtue of a snap action to the left-hand side of the main plate 3 by means of the latching means 10 illustrated in FIGS. 4 and 5.

Figure 10:
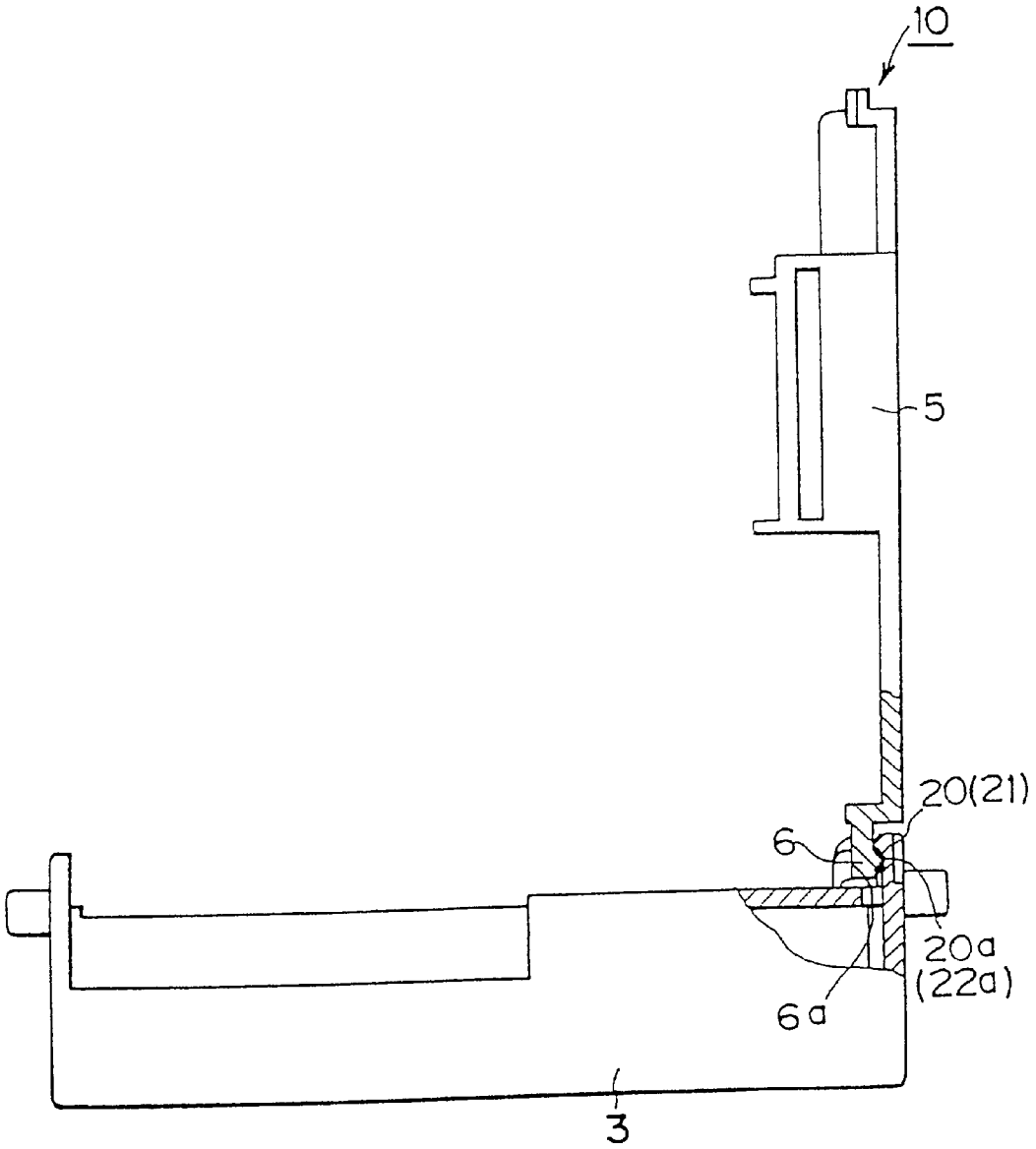
FIG. 10 is a sectional view of the principal part of the coin sorter viewed along the line F—F in FIG. 7.

It should be added that when the shaft 6 of the front cover 5 has been inserted into the bearing means 7 of the main plate 3 and is supported by it as in FIG. 7, the peripheral surface 6*a* of the shaft 6 is supported by the arc-shaped portions 20*a,* 22*a* of the tongues 20, 22, so as to prevent the shaft from becoming detached from within the depressions 23*a,* 24*a* (FIG. 2) as shown in FIG. 10 which is a sectional view of the principal part of the coin sorter viewed along the line F—F in FIG. 7.

In the above embodiment, the invention to which the present application pertains has been described in detail as applied to a compact model of the sort which may especially be installed between pin-ball and other gaming machines, and which handles only a relatively small number of denominations of coin, identifying and sorting two types of coin of differing diameters, and regarding any other coins as counterfeit. However, in addition to the above embodiment, the present invention may also be applied to a larger coin sorter for sorting a large number of denominations such as may be installed inside automatic vending machines and similar apparatus.

There follows a detailed description of an embodiment of a second and third coin sorters to which the present invention pertains.

Figure 11:
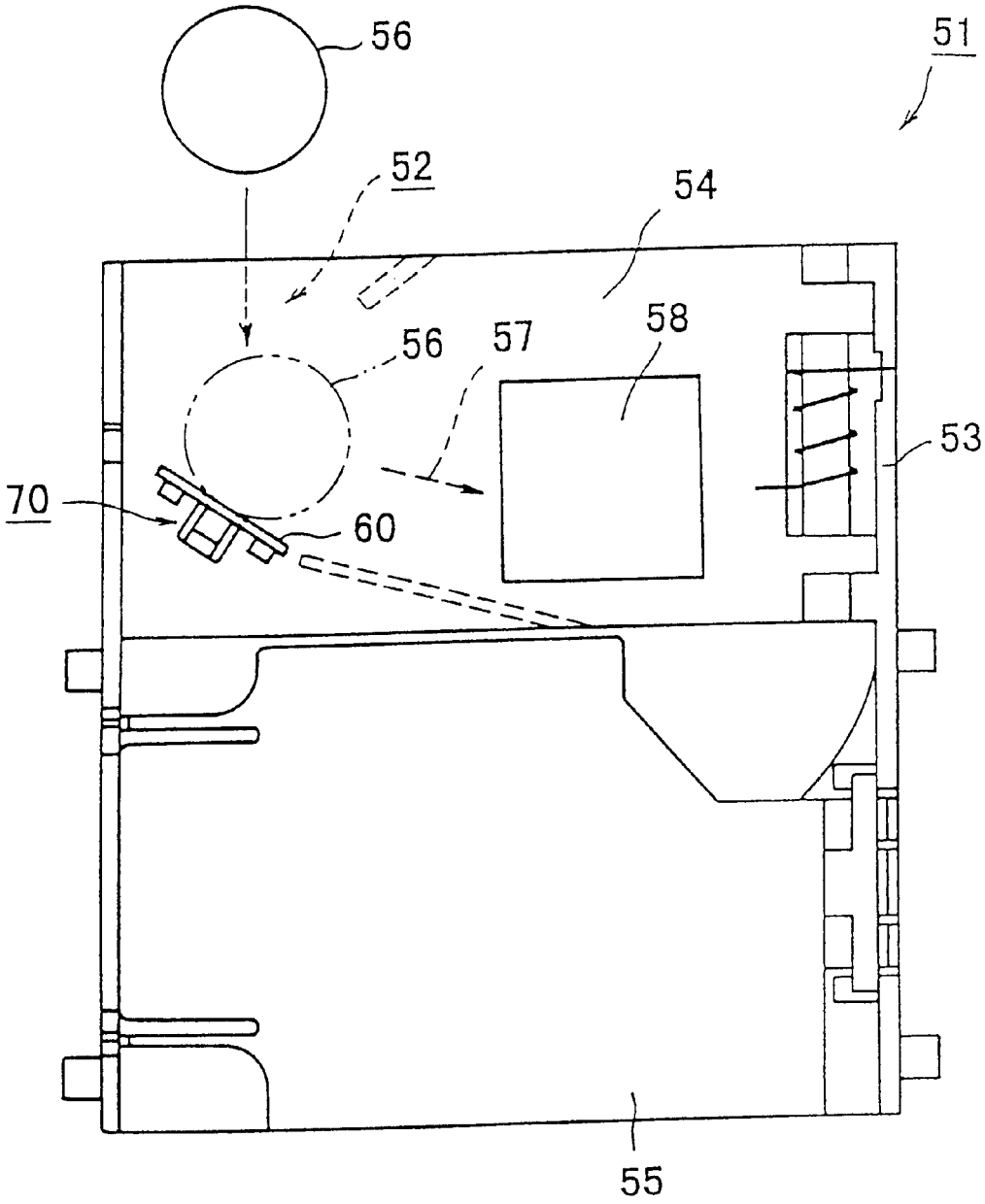
FIG. 11 is a front view of the second and third coin sorters to which the present invention pertains.

FIG. 11 is a front view of the second and third coin sorters to which the present invention pertains.

This coin sorter 51 is also a compact model of the sort which may especially be installed between pin-ball and other gaming machines. It handles only a relatively small number of denominations of coin, identifying and sorting two types of coin of differing diameters and regarding any other coins as counterfeit.

This coin sorter 51 comprises a main plate 53 on the upper surface of which is formed a coin inlet 52. The upper front surface thereof is covered with a gate plate 54, which can be opened and closed freely, while the lower front surface is covered with a front cover 55.

Between this gate plate 54 and the main plate 53 is formed a coin passage 57, which serves to guide coins 56 inserted through the coin inlet 52. This coin passage 57 is equipped with an electronic coin identifying means 58, which serves to identify inserted coins as authentic or counterfeit, and further to identify the denominations of authentic coins.

Moreover, in the part of the main plate 53 which is covered with the front cover 55 are formed coin sorting levers, which will be described later and which serve to sort the inserted coins, and a plurality of coin channels which guide the coins sorted by means of these coin sorting levers according to their denomination.

Meanwhile, on the abovementioned gate plate 54 in a position below the coin inlet 52 is formed snap-type gate rail supporting means 70, into which by virtue of a snap action the gate rail 60 is inserted and thus supported, the gate rail 60 serving directly to stop coins 56 which drop down from the coin inlet 52, and guide them towards the coin passage 57.

There follows a detailed description of the abovementioned gate rail 60 and the snap-type gate rail supporting means 70.

Figure 12:
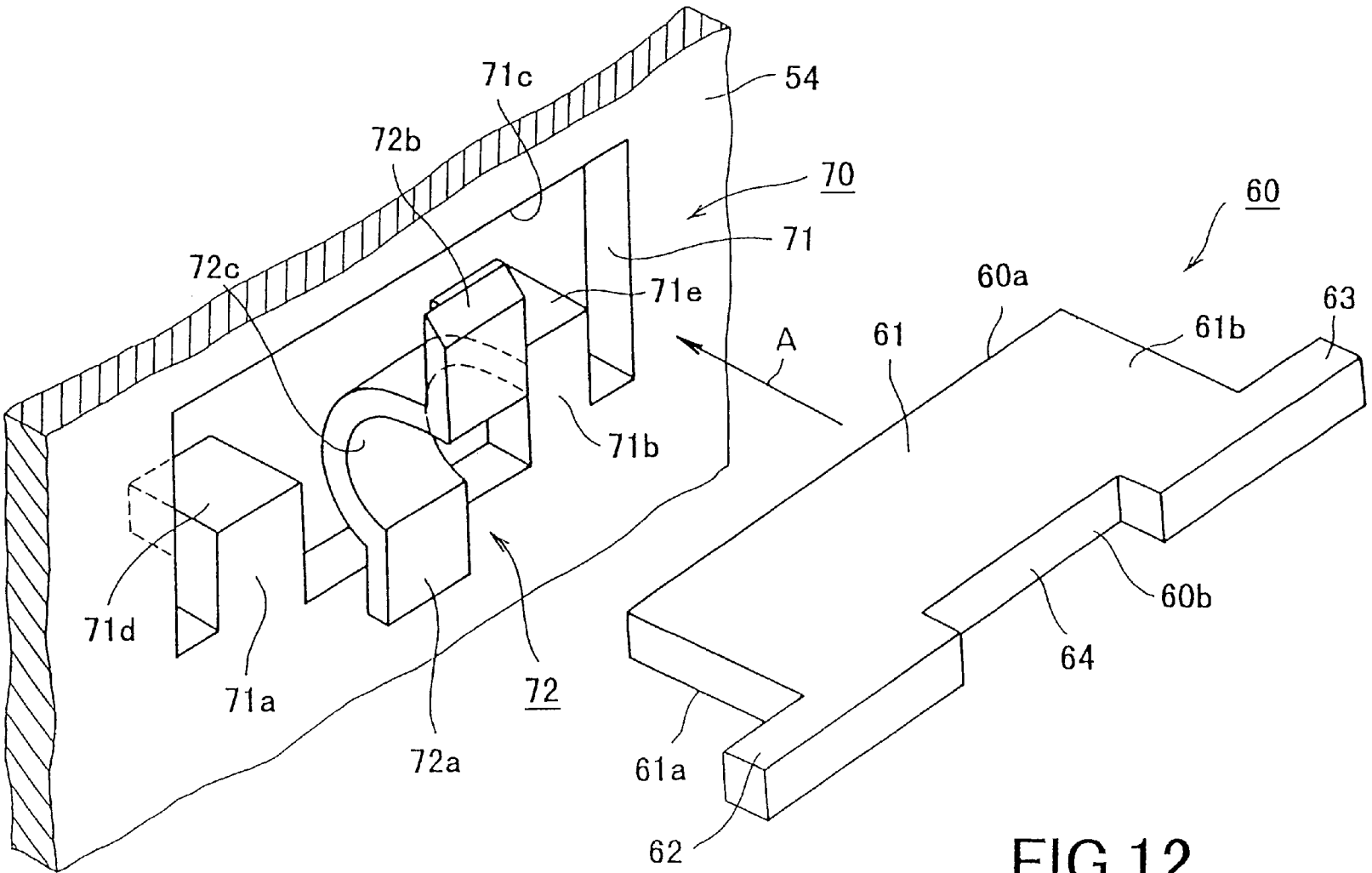
FIG. 12 is an exploded perspective view of principal portions of the second and third coin sorters to which the present invention pertains.

FIG. 12 is an exploded perspective view of principal portions of the gate plate 54.

In FIG. 12, the gate rail 60 is formed with a metal plate 61, behind which extend on either side engagement members 62, 63, with a concave portion 64 formed between them.

Meanwhile, the snap-type gate rail supporting means 70 comprises an aperture 71 into which is inserted the forward portion 60*a* of the gate rail 60, and an engaging claw 72 which is elastic and freely deformed and which supports the trailing edge 60*b* of the gate rail 60 inserted into the aperture 71.

The base 72*a* of this engaging claw 72 is fixed to the gate plate 54, while the free end 72*b* thereof extends towards the top of the aperture 71, there being formed between these a curved portion 72*c* roughly in the shape of an arc, by virtue of which the engaging claw 72 is rendered elastic and capable of being deformed both backwards or forwards and upwards or downwards around the base 72*a*.

On the lower inner peripheral wall of the aforesaid aperture 71 are formed integrally a pair of supporting plates 71*a,* 71*b* which serve to support the lower surface 61*a* of the gate rail 60, while the upper surface 61*b* of the plate 61 which constitutes the gate rail 60 is configured in such a manner that it is supported by the upper inner peripheral wall 71*c* of the aperture 71.

Figure 13:
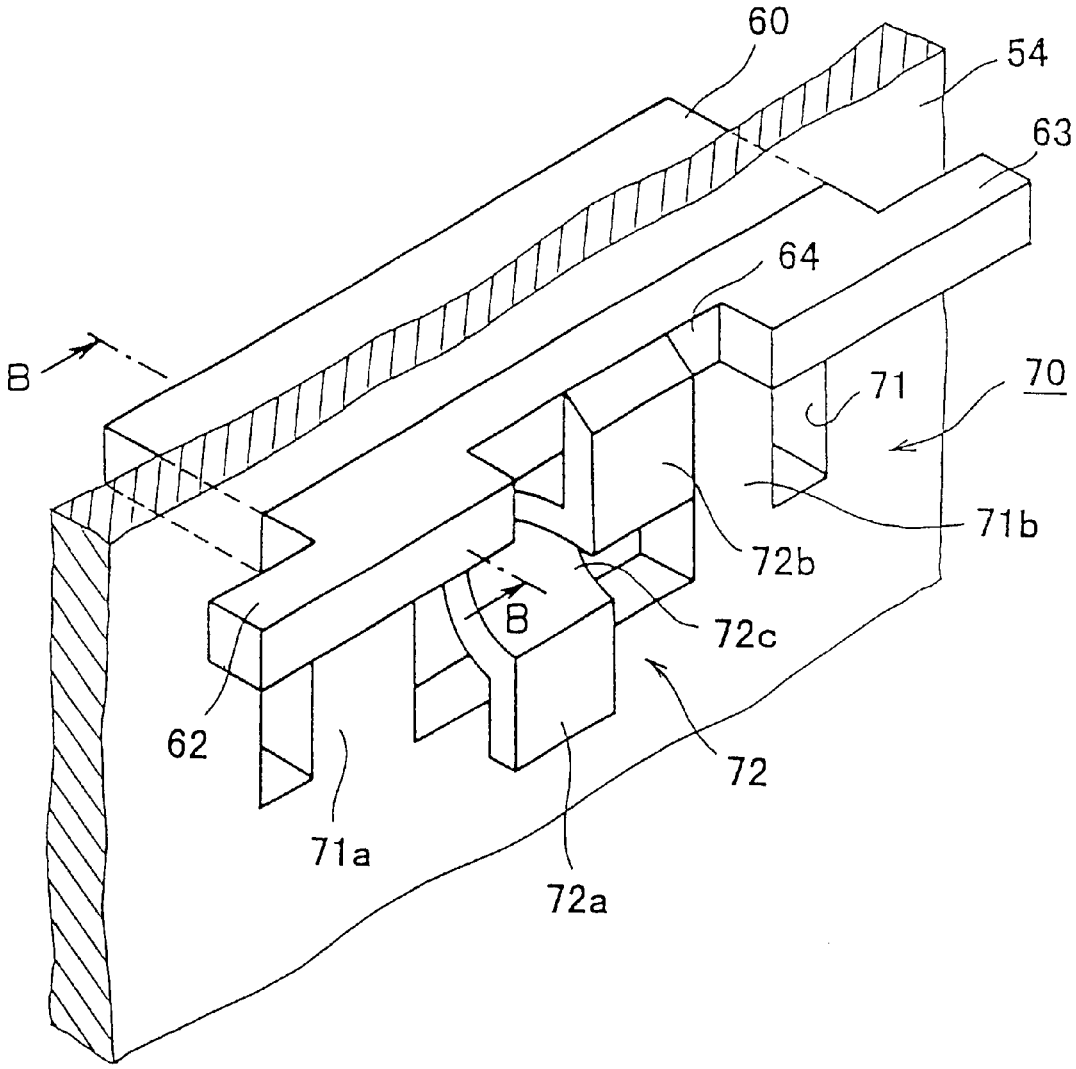
FIG. 13 is a perspective view of principal portions of the second and third coin sorters to which the present invention pertains.

With the snap-type gate rail supporting means 70, the gate rail 60 is brought into the proximity of the hole 71 as represented by the arrow A in FIG. 12, and the leading edge 60*a* thereof is inserted between the upper inner peripheral wall 71*c* of the hole 71 and the free end 72*b* of the engaging claw 72. By virtue of its elasticity and capacity to deform, the curved portion 72*c* of the engaging claw 72 moves downwards, allowing the space between the top and bottom of the aperture 71 to widen and the leading edge 60*a* of the gate rail 60 to be inserted. On insertion, once the concave portion 64 formed on the trailing edge 60*b* of the gate rail 60 has passed the free end 72*b* of the engaging claw 72, the curved portion 72*c* of the engaging claw 72 returns by virtue of its elasticity to its initial position. As a result, the free end 72*b* of the engaging claw 72 engages with the concave portion 64 of the gate rail 60, as FIG. 13 shows. In this manner the gate rail 60 is inserted into the aperture 71 and supported by virtue of a snap action.

Figure 14:
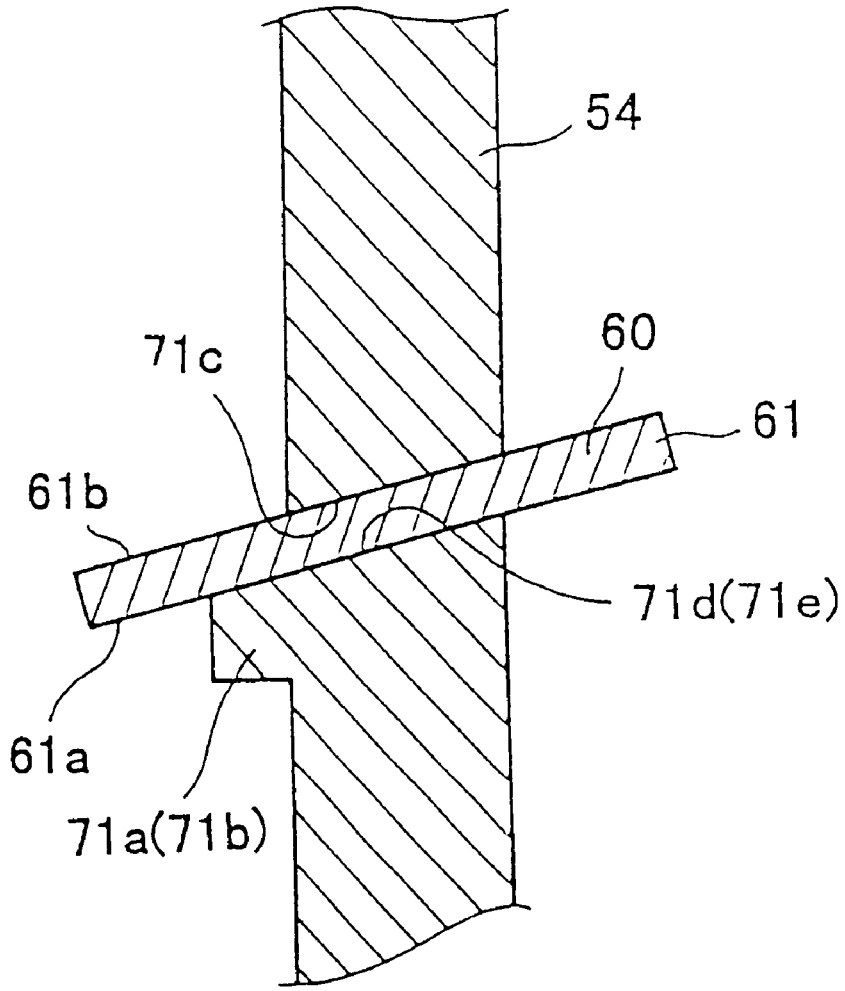
FIG. 14 is a sectional view of the principal part viewed along the line B—B in FIG. 13.

As may be seen from FIG. 14, which is a sectional view of the principal part along the line B—B in FIG. 13, the lower surface 61*a* of the plate 61 which constitutes the gate rail 60 is supported by the inclined upper surfaces 71*d*, 71*e* of the pair of supporting plates 71*a*, 71*b*, while the upper surface 61*b* of the plate 61 is supported, as already mentioned, by the upper inner peripheral wall 71*c* of the aperture 71.

As FIG. 13 shows, the configuration in which the gate rail 60 is inserted into the aperture 71 and supported there serves to ensure that the pair of engagement members 62, 63 on the gate rail 60 engage with the perimeter of the aperture 71 and prevent it from being released.

In order to release the gate rail 60 from within the aperture 71 which constitutes the snap-type gate rail supporting means 70 illustrated in FIG. 13, the free end 72*b* of the engaging claw 72 is pulled somewhat forwards and deflected to disengage the free end 72*b* and the concave portion 64 of the gate rail 60. This allows the gate rail 60 to be released easily from within the aperture 71 which constitutes the snap-type gate rail supporting means 70.

Figure 15:
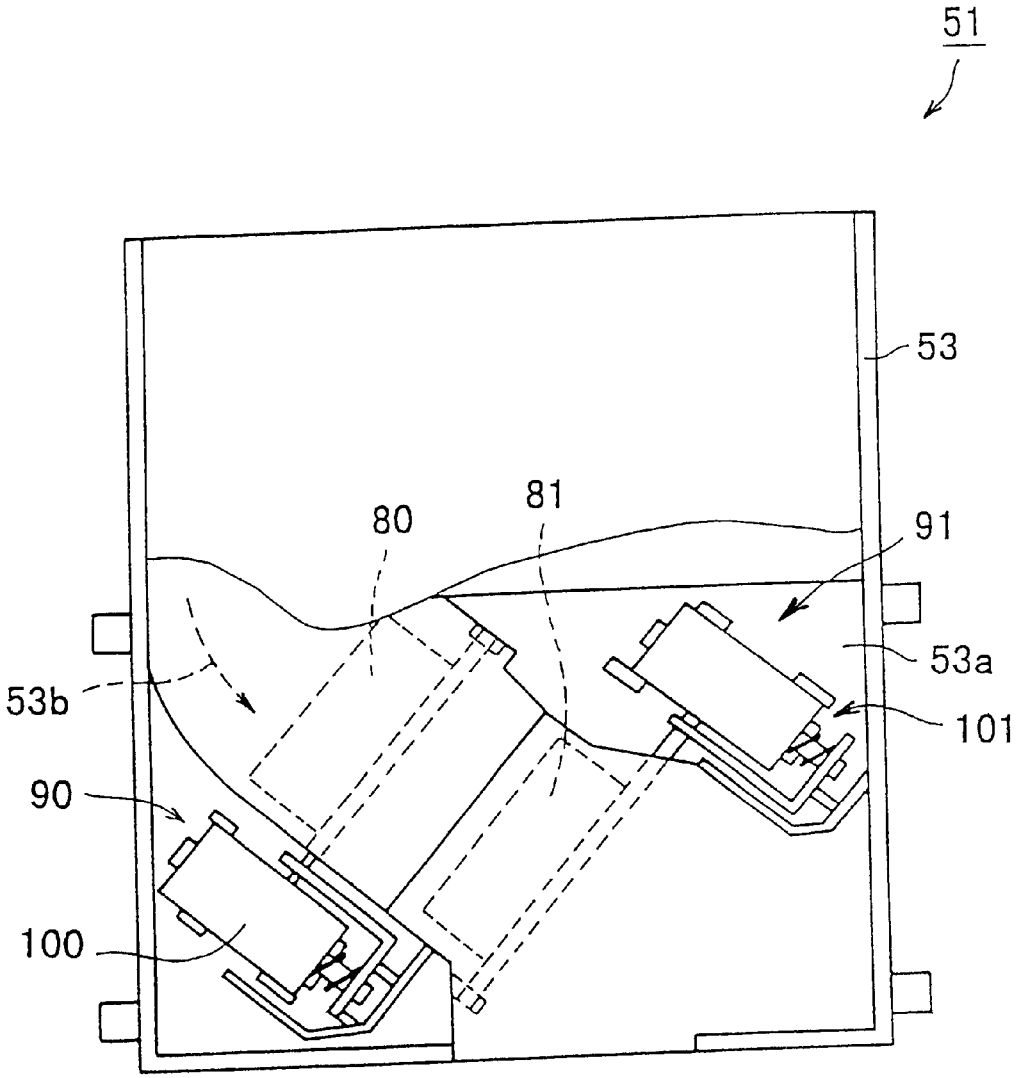
FIG. 15 is a partially cut-away rear view of principal portions of the second and third coin sorters to which the present invention pertains.

The second and third coin sorters 51 to which the present invention pertains, as may be seen from the rear view of principal portions thereof depicted in FIG. 15, have formed on the main plate 53 a coin passage 53*b* which connects to the aforesaid coin passage 57 (FIG. 11). Within this coin passage 53*b* are located two coin sorting levers 80, 81, which serve to channel inserted coins into each of the coin passages not illustrated in the drawing which branch off the coin passage 53*b*.

These two coin sorting levers 80, 81 are configured in such a manner as to be driven by two solenoids 90, 91 located on the rear surface 53*a* of the main plate 53. These two solenoids 90, 91 are supported by two snap-type solenoid supporting means 100, 101, which are formed on the rear surface 53*a* of the main plate 53, and into which by virtue of a snap action the solenoids 90, 91 are inserted and thus supported.

There follows a detailed description of the abovementioned snap-type solenoid supporting means 100, 101. Inasmuch as both these snap-type solenoid supporting means 100, 101 are basically configured in the same manner, the snap-type solenoid supporting means 100 which supports the solenoid 90 will be taken as representative, and a description of the other snap-type solenoid supporting means 101 will be omitted.

Figure 16:
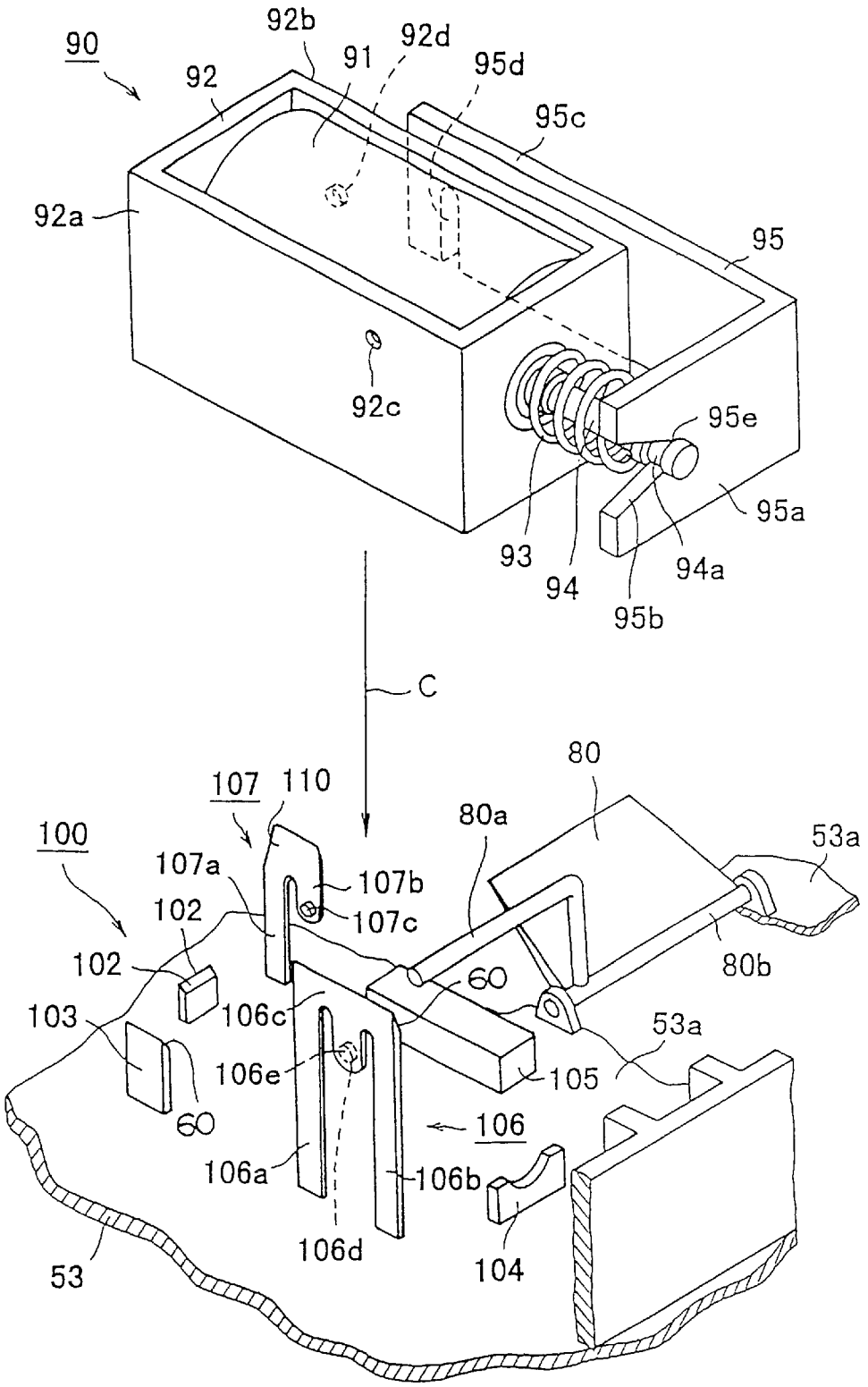
FIG. 16 is an exploded perspective view of principal portions of the second and third coin sorters to which the present invention pertains.

FIG. 16 is an exploded perspective view of principal portions of the second and third coin sorters to which the present invention pertains, and serves to illustrate the abovementioned solenoid 90 and snap-type solenoid supporting means 100. Components which are the same as those illustrated in FIG. 15 have been allocated the same numerals or symbols.

This solenoid 90 comprises an electromagnetic coil 90*a* located at its center, and a metal casing 92 which surrounds it. In the center is supported a plunger 94 in such a manner as to be capable of sliding freely, this plunger 94 being located within a return spring 93. On the leading edge of this plunger 94 is formed a narrower portion 94*a*, which by virtue of a snap action is inserted into and supported by the leading edge 95*a* of an operating lever 95 having an L-shaped cross section. On the leading edge 95*a* of this operating lever 95 is formed a notch 95*b* having a V-shaped cross section, and the narrower portion 94*a* on the leading edge of the plunger 94 is supported in an aperture 95*e* formed at the base of the aforesaid notch 95*b*, in such a manner as to be capable of being attached and detached freely. Moreover, on the trailing edge 95*c* of the aforesaid operating lever 95 is formed a notch 95*d*, which engages with a drive arm 80*a* of the coin sorting lever 80.

Meanwhile, there are located in prescribed positions on the peripheral surface of the casing 92 which constitutes the abovementioned solenoid 90, namely on either side 92*a*, 92*b* of the casing 92 in the embodiment, apertures 92*c*, 92*d* which engage with tongues 106, 107 of the snap-type solenoid supporting means 100.

There follows a detailed description of the snap-type solenoid supporting means 100.

As illustrated in FIG. 16, there is located in a prescribed position on the rear surface 53*a* of the main plate 53 a snap-type solenoid supporting means 100.

This snap-type solenoid supporting means 100 comprises positioning blocks 102, 103, 104, 105 which serve to position the casing 92 of the solenoid 90 in a prescribed location on the rear surface 53*a* of the main plate 53, and a pair of engagement tongues 106, 107 which by virtue of a snap action are inserted into and support the casing 92 of the solenoid 90.

One of the engagement tongues 106 is located in a position corresponding to the aforesaid aperture 92*c* located on one side 92*a* of the casing 92 which constitutes the solenoid 90, while the other tongue 107 is located in a position corresponding to the aforesaid aperture 92*d* which is located on the other side 92*b* of the casing 92.

One of the engagement tongues 106 has overall roughly the shape of an letter M, and comprises a first tongue 106*a* and a second tongue 106*b* with a prescribed distance between them, and a third tongue 106*d* which extends downwards from roughly the center of a bridge 106*c* connecting the tops thereof. On the lower edge of this third tongue 106*d* is located a protrusion 106*e* which is inserted into the aperture 92*c* located on one side 92*a* of the casing 92 which constitutes the solenoid 90.

The other engagement tongue 107 has overall roughly the shape of a letter U, and comprises a first tongue 107*a* which faces upwards, and a second tongue 107*b* which extends downwards from the upper edge of the first tongue 107*a*. On the lower edge of this second tongue 107*b* is located a protrusion 107*c* which is inserted into the aperture 92*d* located on the other side 92*b* of the casing 92 which constitutes the solenoid 90.

It should be added that on the tops of each of these engagement tongues 106, 107 and positioning blocks 102, 103 are formed inclined surfaces 110 in order to facilitate insertion of the casing 92.

Moreover, the reference numeral 80*a* in FIG. 16 represents a drive arm which allows the coin sorting lever 80 to rotate around a shaft 80*b*.

Figure 17:
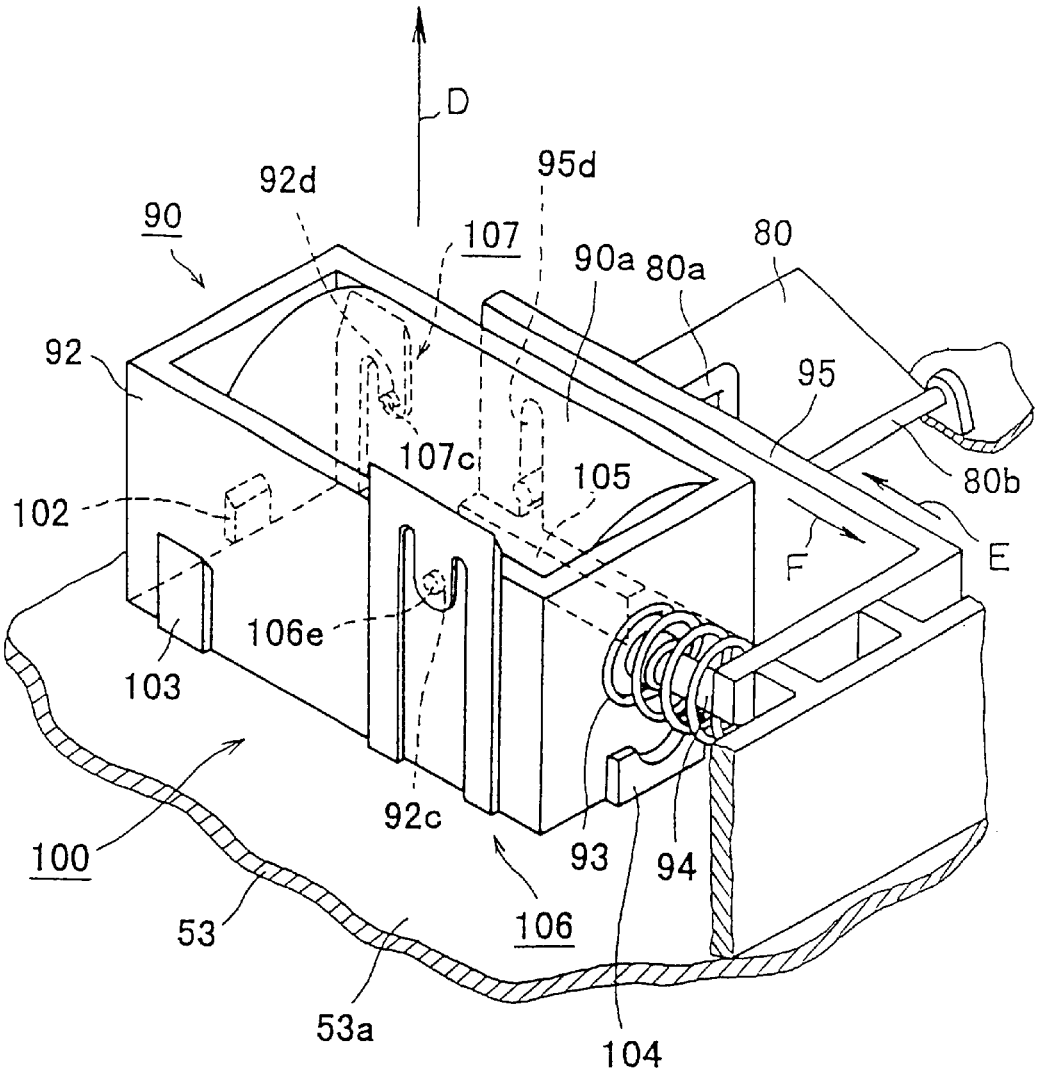
FIG. 17 is a perspective view of principal portions of the second and third coin sorters to which the present invention pertains.

With the abovementioned snap-type solenoid supporting means 100, lowering the casing 92 of the solenoid 90 along with the operating lever 95 as represented by the arrow C in FIG. 16 allows the casing 92 of the solenoid 90 to be positioned with the aid of the positioning blocks 102, 103, 104, 105 as is shown in FIG. 17, and the protrusions 106*e*, 107*c* located on the pair of engagement tongues 106, 107 are inserted into the corresponding apertures 92*c*, 92*d* by virtue of a snap action. At the same time, the notch 95*d* in the operating lever 95 engages with the drive arm 80*a* of the coin sorting lever 80.

With the configuration in which the pair of engagement tongues 106, 107 are elastic and deform in an outward direction around their bases (on the main plate 53) when the casing 92 is inserted between them, the operation of insertion is facilitated.

In particular, with the configuration in which of the pair of engagement tongues 106, 107, the engagement tongue 106 is formed roughly in the shape of a letter M, while the engagement tongue 107 is formed roughly in the shape of a letter U, so as to provide in both cases a good length of tongue from the base to the respective protrusions 106*e*, 107*c*, it becomes possible, while restricting the height of the engagement tongues 106, 107 from the base, to ensure a good degree of elasticity and deformation at the protrusions 106*e*, 107*c*, thus facilitating the operation of inserting the solenoid 90 by virtue of a snap action.

The solenoid 90 can easily be detached from the main plate 53 by causing the engagement tongues 106, 107 to deform in an outward direction in such a manner as to disengage the protrusions 106*e*, 107*c* from the corresponding apertures 92*c*, 92*d*, and then lifting the solenoid 90 upwards as represented by the arrow D.

It should be added that when electricity is passed through the solenoid 90 in FIG. 17, the plunger 94 is drawn towards the electromagnetic coil 91, thus causing the operating lever 95 to move in the direction of the arrow E and causing the engaged drive arm 80*a* to rotate anticlockwise around the shaft 80*b*. When electricity ceases to be passed through the solenoid 90, the plunger 94 returns to its initial position by virtue of the energizing force of the spring 93, at the same time causing the operating lever 95 to move in the direction of the arrow F and causing the drive arm 80*a* of the sorting lever 80 to rotate clockwise around the shaft 80*b* and return to its initial position.

In each of the above embodiments, the invention to which the present application pertains has been described in detail as applied to a compact model of the sort which may especially be installed between pin-ball and other gaming machines, and which handles only a relatively small number of denominations of coin, identifying and sorting two types of coin of differing diameters, and regarding any other coins as counterfeit. However, in spite of the above embodiments the present invention may also be applied to a larger coin sorter for sorting a large number of denominations such as may be installed inside automatic vending machines and similar apparatus.

INDUSTRIAL APPLICABILITY

As has been explained above, the present invention is suitable for use in a coin sorter which sorts inserted coins into authentic or counterfeit, and further sorts authentic coins by denomination.

What is claimed is:

1. A coin sorter comprising:

a main plate which constitutes a body of the device;

a front cover which covers a front surface of the main plate in such a manner as to be capable of being opened and closed freely:

a shaft provided on one edge of the front cover; and bearing means provided on one edge of the main plate for rotatably supporting ends of the shaft, a portion of which bearing means is elastically deformable when the shaft is pressed thereon in a direction perpendicular to the main plate so that the shaft is retained by the bearing means and rotatably supported by the bearing means, thereby the front surface of the main plate is covered with the front cover in such a manner as to be capable of being opened and closed freely by rotating the front cover about the shaft.

2. The coin sorter according to claim 1, wherein the bearing means comprises:

a pair of bearing members for supporting ends of the shaft, upper surface of the bearing members being formed with depressions having half moon-shaped cross section; and a tongue located between the pair of bearing members, and formed with an arc-shaped portion into which a part of a peripheral surface of the shaft is fitted and thus supported.

3. The coin sorter according to claim 1, further comprising rotation restricting means for restricting rotation of the shaft within a predetermined rational angle.

4. The coin sorter according to claim 3, wherein the rotation restricting means comprises:

a first engagement member projecting from a periphery of the shaft; and a second engagement member formed at the main plate in such a position as to abut the first engagement member when the shaft is rotatably supported by the bearing means.

5. The coin sorter according to claim 3, wherein the rotation restricting means comprises:

an engagement member projecting from a periphery of the shaft; and a tongue member projecting from the main plate and formed with an engaging aperture which engages the engagement member when the shaft rotates.

6. A coin sorter comprising:

a main plate which constitutes a body of the device;

a front cover which covers a front surface of the main plate;

a shaft disposed on one edge of the front cover;

a pair of bearing members supporting ends of the shaft disposed on one edge of the main plate with depressions having half moon-shaped cross sections disposed on upper surfaces of the bearing members; and a tongue having an arc-shaped portion into which a part of a peripheral surface of the shaft is fitted disposed between the pair of bearing members rotatably supporting the shaft so that the shaft is fitted into the bearing members from one direction by virtue of a snap action, whereby the front surface of the main plate is covered with the front cover in such a manner as to be capable of being opened and closed freely by rotating the front cover about the shaft.

* * * * *